United States Patent [19]

Torricelli

[11] 4,252,311

[45] Feb. 24, 1981

[54] DISCO STRUCTURE

[76] Inventor: Ugo Torricelli, 44 W. 63rd St., Ste. 717, New York, N.Y. 10023

[21] Appl. No.: 56,072

[22] Filed: Jul. 9, 1979

[51] Int. Cl.[3] ..... A63V 5/00

[52] U.S. Cl. ..... 272/8 P

[58] Field of Search ..... 272/10, 13, 8 D, 8 M, 272/8 R, 8 N, 8 P, 3, 2, 32; 40/503, 504, 505, 502; 35/29 C

[56] References Cited

U.S. PATENT DOCUMENTS

| | | | |
|---|---|---|---|
| 1,649,689 | 11/1927 | Hasait | 272/10 |
| 2,020,603 | 11/1935 | Gearhart | 272/8 D X |
| 2,107,141 | 2/1938 | Colt | 272/3 |
| 2,116,114 | 5/1938 | Guidorossi | 272/10 |
| 2,280,315 | 4/1942 | Shipman | 272/13 |
| 2,418,198 | 4/1947 | Shipman | 272/13 |
| 2,932,918 | 4/1960 | Pearson, Jr. | 272/13 X |
| 3,085,799 | 4/1963 | Alswang | 272/10 |

FOREIGN PATENT DOCUMENTS

| | | | |
|---|---|---|---|
| 109071 | 11/1939 | Australia | 272/13 |
| 507251 | 12/1951 | Belgium | 40/502 |
| 70940 | 9/1893 | Fed. Rep. of Germany | 40/504 |
| 360011 | 9/1922 | Fed. Rep. of Germany | 40/504 |
| 1166931 | 10/1969 | United Kingdom | 40/503 |

*Primary Examiner*—Richard C. Pinkham
*Assistant Examiner*—Arnold W. Kramer
*Attorney, Agent, or Firm*—Jacobs & Jacobs

[57] ABSTRACT

Disco structure comprising a series of triangular elements or prisms mounted for rotation individually or in groups or sub-groups and defining a floor space. Light or projectors are provided for impinging light and/or images on the rotating elements or prisms which are reflective and/or colored on their surfaces and a transparent or translucent shield is disposed inwardly of the elements or prisms through which light rays or beams pass. Sound waves are propagated by a live or inanimate source and a laser beam or other light source revolves in the ceiling over the floor space. A reversible electric motor drives shafts in the elements or prisms through a belt and gearing arrangement.

8 Claims, 7 Drawing Figures

FIG. 4
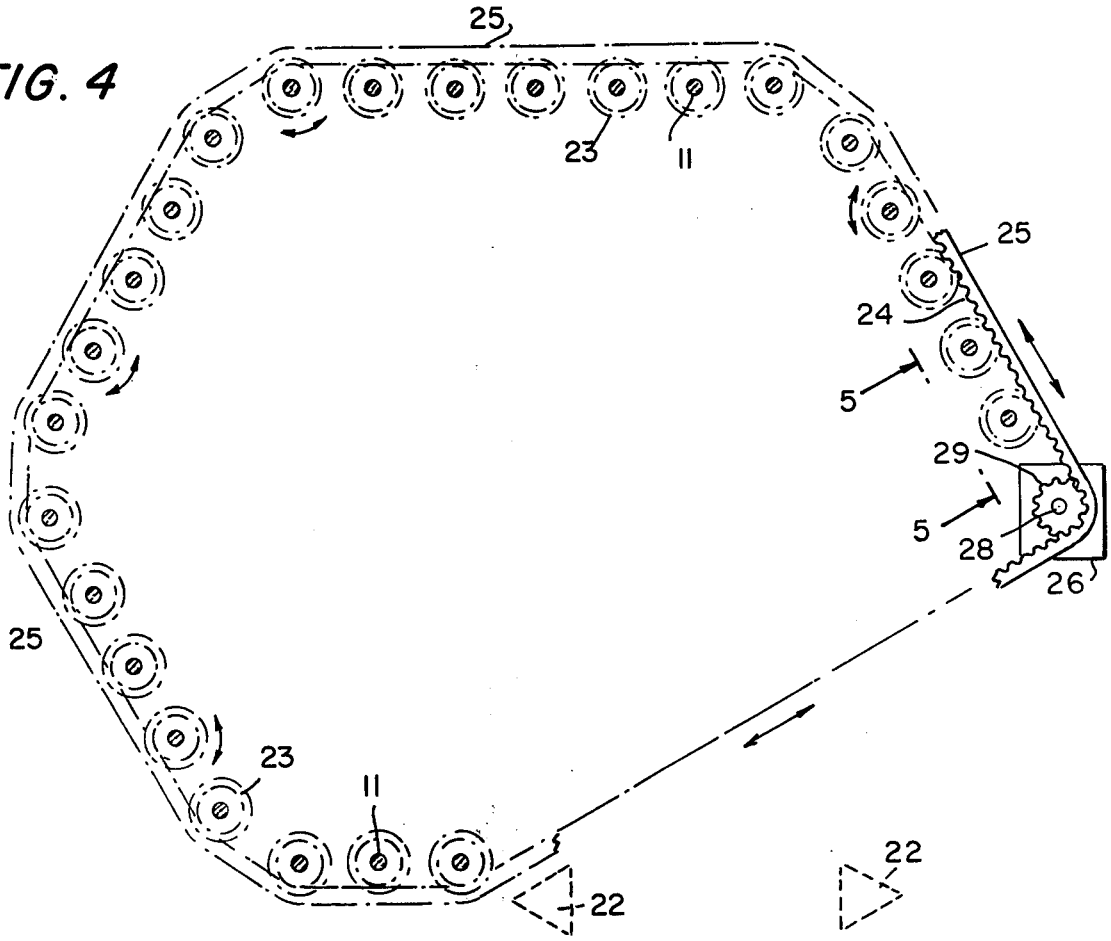
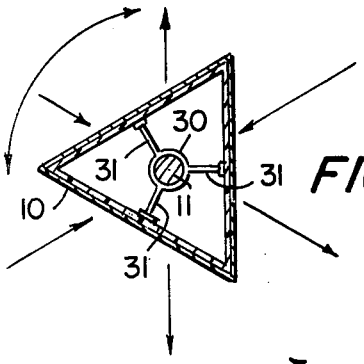
FIG. 6
FIG. 5
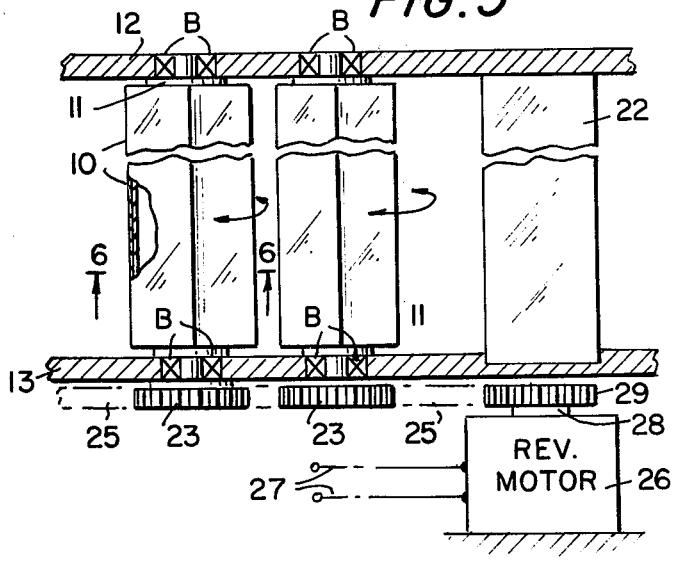
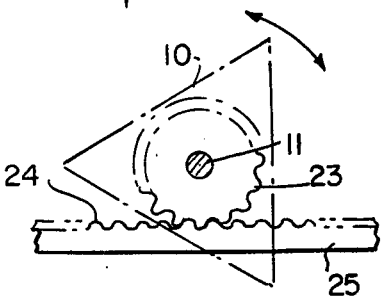
FIG. 7

DISCO STRUCTURE

This invention relates to disco structures, and more particularly to a novel construction and arrangement of elements which can be set up and varied as to configureation and dimensions to accommodate rooms or floor spaces of different sizes and shapes.

What is popularly known today as a "disco" or a "discoteque", must meet certain requirements in order to accommodate different conceptual ideas and artistic tastes. In general, there is provided a floor space which may be ornamented as desired or which may be provided with a glossy or waxed surface for dancing, and also provision is made for sound and lighting effects which may take various specific forms, but which are similar in that they provide the dancers with sound and lighting effects of a random pattern. While there are different specific forms of "discos", they tend to become stereotyped and lack individuality in their arrangements.

According to the present invention, a novel and markedly different Disco Structure is provided which is readily adaptable to rooms of various shapes and sizes, while, at the same time, providing features which are not found in the usual Discos. In addition, the present invention provides for an almost infinite variety of physical arrangement and illumination produced by rotating elements which have colored and/or reflecting surfaces and which elements are mounted in a series which can be adapted to virtually any room size or shape and which provides unusual and unique lighting and visual effects and also sound effects.

It is, therefore, the major object of this invention to provide a novel disco structure which departs from known arrangements and which has advantages not shared by known structures.

A preferred embodiment of the invention is illustrated in the accompanying drawings wherein:

FIG. 4 is a diagrammatic view of the belt and gearing arrangement for driving the individual elements;

FIG. 5 is a fragmentary elevational view showing the mounting of the individual elements and the means for rotating the same;

FIG. 6 is a transverse section taken on line 6—6 of FIG. 5; and

FIG. 7 is a detail of the driving belt showing it in contact with a gear of a rotating element.

Figure 1:
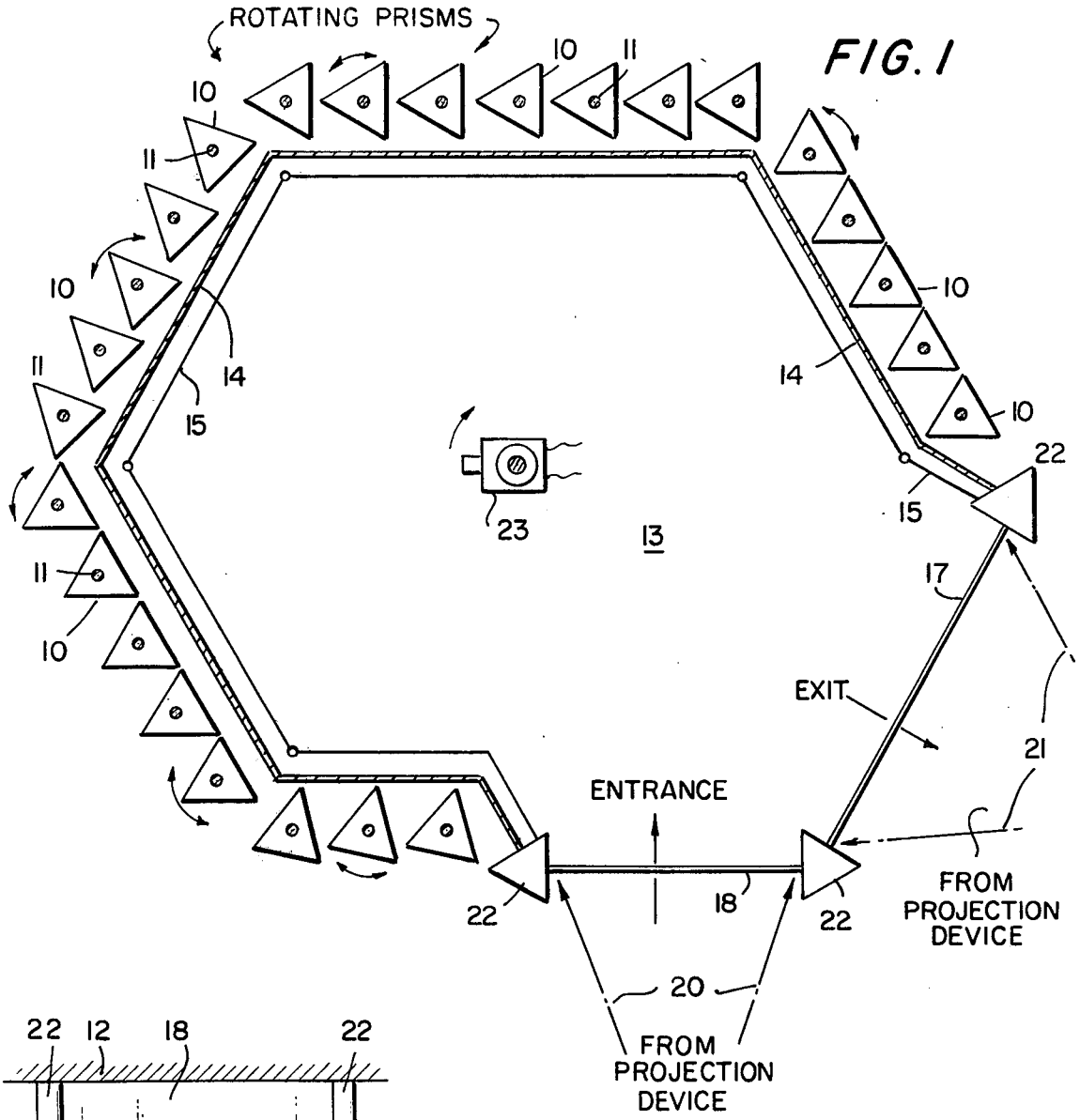
FIG. 1 is a schematic plan view looking down to the floor space formed by the arrangement of the elements.

Referring to the drawing there are a series of triangular elements 10, each of which is provided with a shaft 11 and usually and preferably each element 10 is not only of triangular shape in cross-section, but is composed of a synthetic plastic material of any desired nature which is either glossy on its outer surface, or has a gloss imparted to it, or preferably is provided on its external surface with a reflecting material such as a thin skin of aluminum or shatter-proof glass, parts of which may further be colored either entirely or in predetermined areas such as pink, blue, green etc. Each triangular element 10 normally is disposed in an upright position in such manner that the shaft 11 extends at its upper end into a ceiling or other horizontal member in which is provided a plurality of bearings B to facilitate turning of the shaft 11. Such bearings may be of any standard or conventional form such as a channel ring having ball bearings therein against which the shaft has a rotating contact. Similarly, the lower end of the shaft 11 is also mounted in a like bearing in the floor 13, and it will be noted from FIG. 5 that the triangular elements 10 are relatively closely spaced so that there is just about enough clearance for each triangular element to be rotated without making physical contact with the adjacent triangular elements. The number of triangular elements can be varied depending upon the space available and the size of the room in which they are located, and hence the arrangement shown on the drawings is preferred but is to be understood as typical only, since other patterns can be employed to adapt the same to the desires of the builder or operator.

Figure 2:
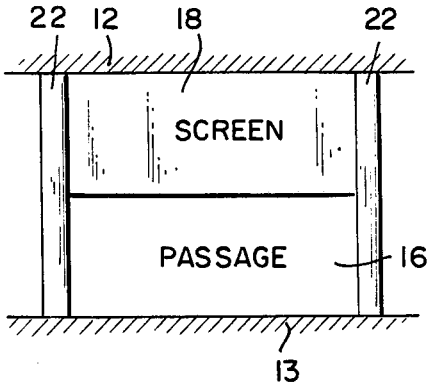
FIG. 2 is a detail elevational view of the entrance to the floor space.
Figure 3:
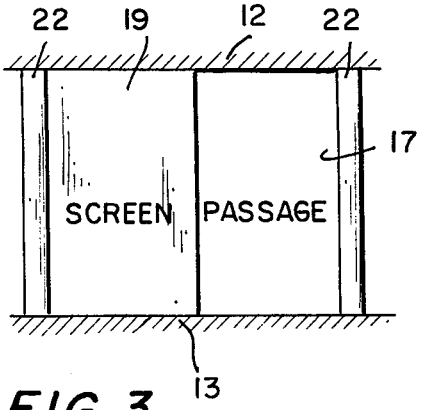
FIG. 3 is a detail elevational view of the exit from the floor space.

It will be seen from FIG. 1 that the series of triangular elements 10 is so arranged as to define a floor space 13 for dancing and similar purposes, and in order to prevent the people using the disco from accidental contact with the rotating triangular elements 10, a plastic transparent or translucent shield 14 is provided which is spaced somewhat inwardly from the rotating triangular elements, herein also called "prisms", and due to the nature of the protective shield 14 the prisms are visible therethrough, and also for protective purposes a rail 15 or other suitable fence-like member is provided for the safety of the people on the floor. It will further be observed from FIG. 1 that while the series of prisms forms an enclosure, that enclosure is incomplete to the extent that no prisms are used in two areas, namely an entrance area 16 and an exit area 17, which provide suitable ingress to and egress from the floor area 13. FIG. 2 shows one form of ingress wherein there is a screen 18 arranged horizontally above the entrance passage 16, and which screen 18 is adapted to have still or motion pictures projected from the rear thereof as shown at 20, whereby images are projected on the rotating prisms 10 to add to the visual effects and enjoyment of the dancers, but without obstructing their ingress and egress. Similarly, there is a vertically arranged screen 19 of the same nature as screen 18, and for the same purpose, and it adjoins the vertical passage 17, and in this case the projection device 21 causes still or moving images to be projected against the rotating prisms 10. In this way adequate ingress and egress are provided to meet all fire laws or building code requirements. The screens 18 and 19 have fixed positions held in place by stanchions 22, or other upright structural members which may be made of any desired material of required strength and rigidity. FIG. 1 also shows diagrammatically a light source 23 which is of my standard or conventional nature such as a rotating laser beam or a rotating or stationary series of illuminating elements.

Each shaft 11 of each prism 10 extends downwardly below the flooring 13 and is provided on the lowermost end thereof with a gear 23 which meshes with the complementary surface 24 of belt 25, and which belt is driven by a motor 26 which can be reversible or irreversible and which is connected in the usual manner with a source of electric current represented by the wiring 27. The shaft 28 of the motor 26 is provided with a drive gear 29 which actuates the belt 25 and the movement of which belt causes rotation of the gears 23, and hence the prisms 10. It is to be understood, however, that the prisms may be caused to rotate individually or in groups or sub-groups, and that the belt and gearing can be readily arranged for such purpose in order to make it possible to rotate individual prisms or groups or sub-groups of prisms in different rotational directions simultaneously, thereby adding to the visual effects particularly when some of the prisms are provided with the surface areas of different colors such as pink, green or blue, and particularly also when areas of the prisms are provided with reflective coatings such as aluminum or other light polished metal or alloy, or the synthetic plastic material of the prisms may be polished or waxed or otherwise coated or painted in any one of a great variety of ways. Thus the disco arrangement is very versatile and provides novel and unusual visual effects which are attractive and different from ordinary or usual discos which tend to be stereotyped. It is understood further that sound waves may be propagated from any convenient source which can either be live or inanimate, and when live can be a band or group of musical instruments, and when inanimate may be "canned", i.e. from a stereo or record player.

In operation and with the prisms rotating and the lighting effects and musical sounds in operation it will be appreciated that the disco of the present invention not only has a novel and unusual structure, but provides unique and highly attractive and desirable sound and/or lighting effects. Furthermore, it will be appreciated that an advantage of the present invention is that it may be constructed to practically any size or shape of room or space, and that it meets all building code and fire laws with regard to safety and ingress and egress.

It is still further to be understood that the triangular elements herein called prisms can, if desired, be of other polygonal shape and of course can be arranged in any desired or suitable manner, depending upon the space available and the arrangement of the walls of that space. In addition, it has been found that while vertically disposed prisms are preferred, it is readily possible to arrange the same in horizontal or diagonal fashion with suitable adaptation of the mounting of the gearing, belting and bearings which would then be in the wall surfaces instead of the floor and ceiling members of the building structure. The foregoing is therefore intended as illustrative and not as limitative, and within the scope of the appended claims other physical arrangements can be utilized.

The prisms 10 are preferably hollow as shown in FIGS. 5 and 6 to save weight and material and in that case simple means such as triangular cap plates (not illustrated) fit into the prism ends to hold the shafts 11 centrally disposed. Alternatively, simple brackets are provided having a ring or collar 30 fitted over the shaft ends and radial extensions 31 reaching to the prism interior wall. The prisms 10 may optionally be solid throughout their length in which event their shafts 11 extend through the plastic or other material of the prisms during casting or forming of the prisms, or the end portions only of the prisms may be solid and the shafts thereby held in such solid end portions, or any combination of such constructions. Moreover, instead of using a single belt 25 passing over and actuating all the gears 23, a plurality of belts passing over and actuating groups or sub-groups of gears may be utilized with a separate reversible motor drive for each group or sub-group of prisms and in such case the motors are connected into and actuated by a master console or control panel which is provided with known types of actuatable levers, push-buttons or knobs which cause the motors to run synchronously in one direction or out of synchronism in reverse and in forward and reverse directions or combinations thereof in the manner of a computer control. It is further to be understood that protective shield 14 may be omitted, if desired, or may be vertically slit at intervals to form a shield of ribbon-like nature between slits.

What is claimed is:

1. A disco structure comprising a series of elements of triangular cross-section arranged in a predetermined pattern to define a floor space, a transparent or translucent shield spaced inwardly from and generally paralleling the pattern of elements and means for holding said shield in position, means for mounting the elements for independent rotation or for rotation in groups or sub-groups, light source means for impinging light rays or beams through said shield on said elements, means providing ingress to and egress from said defined floor space and for optionally projecting images or scenes on said shield and elements, said elements, shield and floor space having reflecting and colored surfaces or surface areas thereby creating multi-directional lighting and reflecting effects of constantly changing nature and patterns during rotation of said elements.

2. A structure according to claim 1, wherein each element is provided with a longitudinal rotatable shaft extending at one end through the floor and at the other end through the ceiling and bearing means mounted in the floor and ceiling having ball or roller bearings in contact with said shaft ends, said shafts having gearing in contact with belting which is motor driven to cause rotation of the triangular elements.

3. A structure according ro claim 2, wherein sound waves are propagated from a live or inanimate source for commingling with and complementing the light rays and beams.

4. A structure according to claim 1, wherein the means providing ingress and egress have an open part serving as a passage and a closed part which is a rear projection screen for reception of still and moving images and scenes thereon.

5. A structure acccording to claim 1, wherein the triangular elements are vertically disposed and spaced apart just sufficiently to provide room for individual rotation.

6. A structure according to claim 1, wherein the triangular elements are solid and composed of synthetic plastic having the reflecting and colored surface areas randomly or uniformly thereon as an outer layer or film.

7. A structure according to claim 1, wherein the triangular elements are hollow.

8. A structure according to claim 1, wherein the mounting means includes one or more reversible electrical motors for driving said elements or groups or sub-groups thereof through gears and belts in synchronism or non-synchronism.

* * * * *